United States Patent [19]

Magers et al.

[11] 4,369,899

[45] Jan. 25, 1983

[54] DOWN-LOCKING PUMP

[75] Inventors: Wallace F. Magers, Leawood, Kans.; Donald D. Foster, Kingsville, Mo.

[73] Assignee: Realex Corporation, Kansas City, Mo.

[21] Appl. No.: 207,892

[22] Filed: Nov. 18, 1980

[51] Int. Cl.[3] ..... B65D 47/34

[52] U.S. Cl. ..... 222/153; 222/321; 222/384

[58] Field of Search ..... 222/153, 321, 402.11, 222/402.14, 321, 384

[56] References Cited

U.S. PATENT DOCUMENTS

| | | | |
|---|---|---|---|
| 2,083,058 | 6/1937 | De Weal | 222/321 |
| 2,088,790 | 8/1937 | Huthsing | 222/321 |
| 2,103,932 | 12/1937 | Bernhardt | 222/384 |
| 2,846,124 | 8/1958 | Stewart et al. | 222/321 |
| 3,086,716 | 4/1963 | De Kolb | 222/153 |
| 3,321,111 | 5/1967 | Jellinek | 222/321 |
| 3,422,996 | 1/1969 | Lipman | 222/402.11 |
| 3,706,401 | 12/1972 | Gach | 222/153 |
| 4,162,746 | 7/1979 | Anderson et al. | 222/321 |

*Primary Examiner*—H. Grant Skaggs

*Attorney, Agent, or Firm*—Schmidt, Johnson, Hovey & Williams

[57] ABSTRACT

When the plunger is fully depressed, radially projecting lugs carried by the plunger adjacent its normally upper end may be received within corresponding notches in a collar through which the plunger reciprocates, whereupon rotation of the plunger in a clockwise direction moves the lugs under overhanging shoulders of the collar so as to prevent extension of the plunger until it is intentionally unlocked from the collar. A total of three lugs are utilized so as to provide three-point, stabilized retention of the plunger in its locked-down condition, and one of the lugs and its corresponding notch is smaller than the other two so that the plunger can be locked only when it is in a certain, predetermined rotative position relative to the collar aligning the downsized lug and notch. Each of the shoulders is provided with a lower, lug-engaging, inclined surface which bears against its corresponding lug with progressively increasing force for fluid-tight sealing purposes as the plunger is rotated into a fully locked condition, there being abutments associated with the shoulders blocking movement of the lugs beyond positions corresponding to the fully locked and rotated position of the plunger.

7 Claims, 9 Drawing Figures

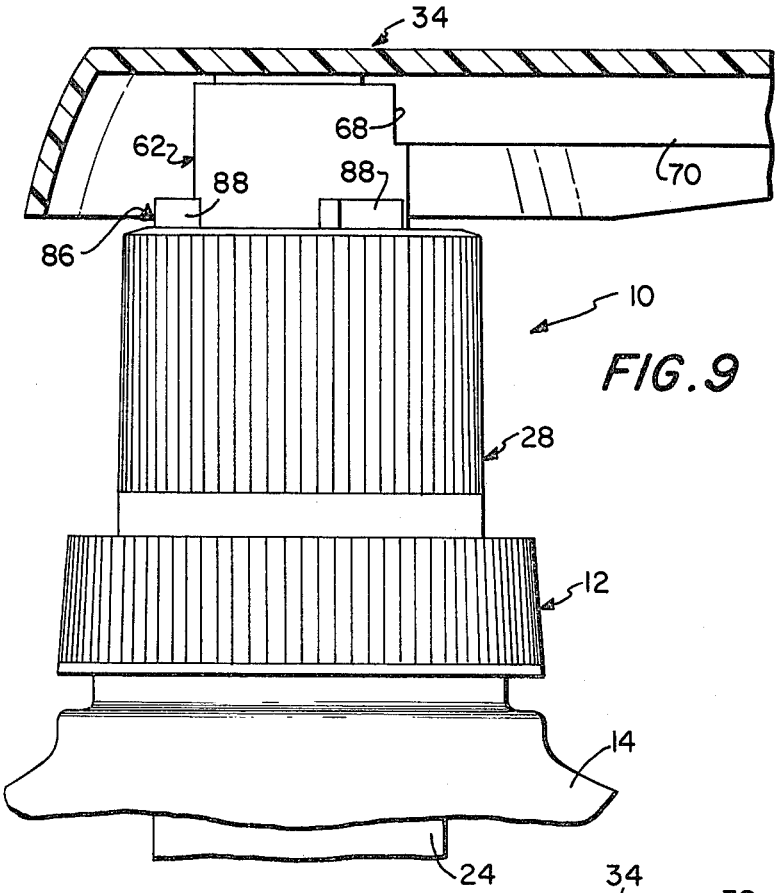
FIG. 9
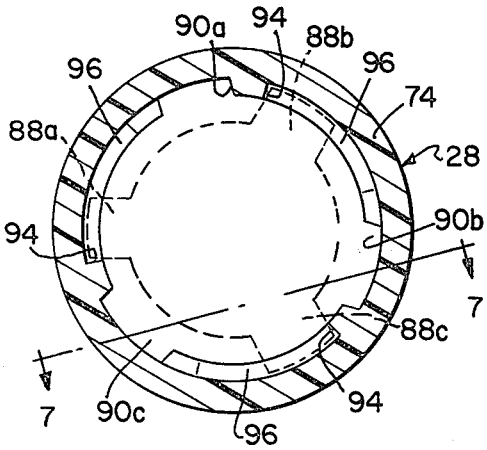
FIG. 6
FIG. 8
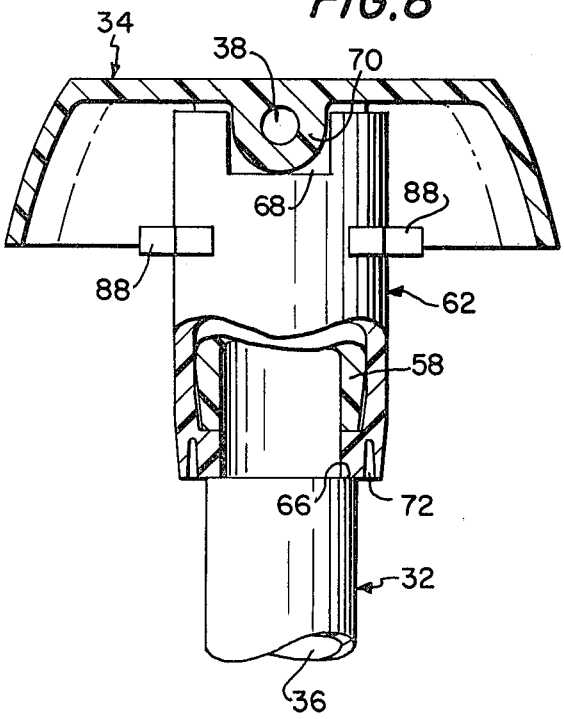
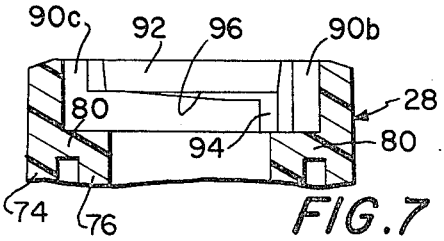
FIG. 7

DOWN-LOCKING PUMP

TECHNICAL FIELD

This invention relates to the field of manually operated dispensing pumps and, more particularly, to pumps having plungers which may be locked down in fully depressed positions for shipment or other handling.

BACKGROUND ART

Locking down the plunger of a pump is highly desirable after the pump has been installed on a product-filled container and is prepared for shipment. In the locked-down position, considerably less space is occupied by the pump than when the plunger is fully extended, thereby resulting in significant savings in terms of packaging, shipment and eventual display on merchandising shelves. Moreover, locking down the plunger aids in effecting proper seals to prevent accidental leakage of the product in the event that the container is laid on its side or inverted.

Once the plunger is in its locked-down position, it is important that the plunger be very stably retained, inasmuch as wobbling or rocking of the plunger may have a deleterious effect upon the quality of various fluid-tight seals which are effected at this time. Moreover, it is important that the plunger be locked down in a manner to impart a predetermined amount of compressive loading at such various seal points in order to assure that the intended safeguards against leakage are indeed implemented.

While it is generally desirable, then, to achieve a locked-down capability, at the same time, it is important that this feature not interfere with and adversely affect the dispensation of predictable, uniform doses or portions of product during each pumping stroke of the unit. In this regard, the position in which the plunger is actually locked down represents a somewhat further depressed position of the plunger beyond that normally attained during pumping operations. If appropriate measures are not taken, the user might rather easily depress the plunger further than intended by the manufacturer to the full extreme desired only in locking situations, such additional stroke length resulting in a greater-than-intended dose or portion size being dispensed.

Additionally, many of the product containers with which pumps of this type are utilized have a transverse elongation or ovality which is taken into consideration during packaging with other of the units in bulk for shipment. Desirably, such containers are packed with their elongations oriented in the same manner and, in those units where projecting dispensing spouts are utilized, such spouts are likewise desirably oriented to project in the direction of elongation of the containers. It is necessary in such instances for the plungers to be locked down, yet so designed that their spouts can still be reoriented in this manner.

SUMMARY OF THE PRESENT INVENTION

One important object of the present invention is to provide a down-locking pump which provides a predictable amount of compressive loading at the various seal points of the pump when the latter is in a locked condition, which provides a very stablized retention of the plunger in its locked condition in order to maintain the integrity and quality of the sealing engagements occurring at such seal points, which provides help in assuring that, once unlocked, the plunger is not easily accidentally, shifted beyond its normal depression stroke to an additionally depressed condition intended only for locking, and which additionally provides for reorientation of the spout despite the plunger being held in its locked-down position.

Pursuant to the foregoing, the present invention provides a set of three locking lugs on the plunger adjacent its normally upper end, such lugs being receivable within mating notches of the collar that reciprocably guides the plunger during its operation. The radially projecting lugs may enter the notches when the plunger is fully depressed, whereupon slight rotation of the plunger in a clockwise direction causes the lugs to slip beneath overhanging shoulders associated with the collar. Inclined cam surfaces on the underside of the shoulders bear against the lugs with progressively increased force as the lugs are rotated into place, thereby thrusting the plunger downwardly by an additional increment to firmly effect fluid-tight seals at various points of the unit. A total of three lugs is provided so that the resulting engagement in a locked-down condition is of a solid, stable, three-point nature. One of the lugs and its notch is smaller than the other two lugs and their notches so that locking may occur only when the plunger is in one particular rotative position aligning the small lug with the small notch. Since, once unlocked, the plunger is free to rotate relative to the collar to any one of a wide assortment of rotative positions, the chances that the specially sized notch and lug will accidentally become realigned is fairly remote, to the end that the lugs strike the top sides of the shoulders during normal operations and serve as stroke limiters. Abutments depending from the three shoulders are located at the ends of the paths of travel for the locking lugs beneath their respective shoulders, thereby determining the limits of travel of the lugs in the locking mode. Such relationship also effectively connects the plunger and collar together for combined clockwise rotation as a unit if an orienting force is applied to the spout in a clockwise direction to align the spout in the intended manner, at which time the collar simply rotates relative to the container.

BRIEF DESCRIPTION OF THE DRAWINGS

FIG. 6 is a transverse cross-sectional view through the pump taken substantially along line 6—6 of FIG. 2;

FIG. 7 is a cross-sectional view through the locking components of the pump taken substantially along the oblique sight line 7—7 of FIG. 6;

FIG. 8 is a fragmentary elevational view of components of the pump adjacent its upper end, parts being broken away and shown in cross section for clarity; and FIG. 9 is a fragmentary side elevational view of the pump and associated container with the pumping head shown in cross section to reveal partial details of the lock therebeneath.

DETAILED DESCRIPTION

Figure 2:
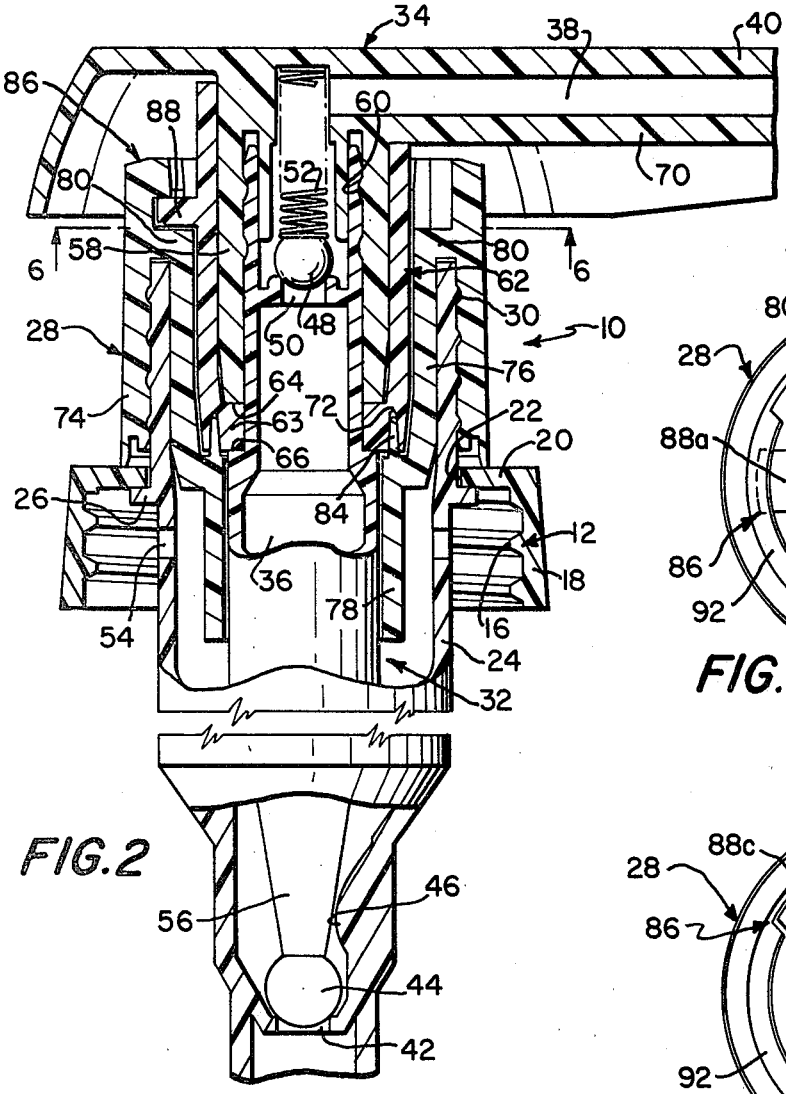
FIG. 2 is an enlarged, fragmentary view of the pump partially in cross section and partially in elevation revealing details of construction.

The pump 10 is installed upon the closure 12 of a container 14 having a threaded neck finish (not shown) which mates with internal threads 16 of the closure 12 formed on the annular sidewall 18 thereof. The top wall 20 of the closure 12 is provided with a centrally disposed opening 22 through which the upper portion of tubular body 24 of the pump 10 projects. An external, annular flange 26 on the body 24 rests upon the top edge of the neck finish in order to suspend the lower portion of the body 24 down into the interior of the container 14.

The pump 10 further includes an annular collar 28 snapped onto the upper end of the body 24 via parallel, interfitting beads and grooves denoted broadly by the numeral 30. The fit between beads and grooves 30 is such that the collar 28 may rotate about the upper end of the body 24 if sufficient torque is applied to the collar 28, it being noted that the collar 28 is not merely loosely held onto the body 24, however. The collar 28 serves to attach pump 10 to the closure 12 such that the closure 12 and the pump 10 together form an assembly which can be threaded onto and off of the container 14 as desired.

The collar 28 is located in axial registration with the body 24 and functions to provide a bearing surface for the reciprocable plunger 32 of the pump 10 having an operating head 34 at its upper end which may be manually depressed and raised in order to reciprocate the plunger 32 and operate the pump 10. A piston seal (not shown) adjacent the lower end of the plunger 32 makes sealing contact with the interior surface of the body 24 for the purpose of pumping products into the body 24 below the seal during an upstroke of the plunger 32, and for pumping such products out of the body 24 via a passage 36 in the plunger 32 during a down stroke of the latter. From the passage 36, the products flow to an outlet 38 in the spout 40 of the head 34.

The pump 10 further includes an inlet 42 at the lower end of the body 24 communicating the interior of the container 14 with the interior of the body 24. Inlet 42 is controlled by a ball check valve 44 which seats against the inlet 42 to close the latter during a down stroke of the plunger 32 and which rises off the inlet 42 to open the latter during an upstroke of the plunger 32. Upward movement of the ball valve 44 is limited by a series of inwardly projecting nibs 46 on the body 24 a short distance above the ball 44. A second ball valve 48 is located within the passage 36 adjacent the upper end of the plunger 32 for controlling an outlet 50 that communicates the interior passage 36 with the outlet 38 of spout 40. Upper ball valve 48 is yieldably biased into a position closing the outlet 50 by a compression spring 52, the ball 48 closing the outlet 50 during an upstroke of the plunger 32 and opening the outlet 50 during a down stroke of the plunger 32. Vent holes 54 in the body 24 slightly below the flange 26 allow the ingress of ambient air into the container 14 from along the interface of the plunger 32 and the collar 28 for the purpose of equalizing pressure externally and internally of the container 14 during the upstroke of the plunger 32.

The plunger 32 is provided with a hollow projection 56 depending from the lower end thereof for the purpose of holding down the ball check valve 44 at such time as the plunger 32 is in a fully depressed position as illustrated in FIG. 2. Suitable orifices (not shown) are provided in the projection 56 for the purpose of allowing entry of products into the passage 36 of plunger 32 during the down stroke of the latter.

The plunger 32 is of reduced diameter adjacent its upper end and is securely received within a depending annular portion 58 of the head 34 at that location. Interfitting beads and grooves 60 permit the plunger 32 and the annular portion 58 to be snapped together in tight interengagement so that the head 34 and the plunger 32 effectively become a single unit without relative rotational movement being permitted between such two components. A sleeve 62 receives the depending annular portion 58 and has a radially inwardly disposed, annular section 63 at its lower end that is trapped between the lower end 64 of the annular head portion 58 and an upwardly facing ledge 66 formed at the initiation of the reduced diameter portion of the plunger 32 so that sleeve 62 effectively forms a part of and is carried with the plunger 32 during reciprocation of the latter. As illustrated perhaps most clearly in FIG. 8, an indentation 68 in the top edge of the sleeve 62 receives the normally horizontally extending tubular section 70 of the spout 40 containing the internal outlet passage 38. Thus, the sleeve 62 and the head 34 are held by the indentation 68 and tubular section 70 against relative rotation. A downwardly opening annular groove 72 is formed in the bottom of the sleeve 62.

Figure 3:
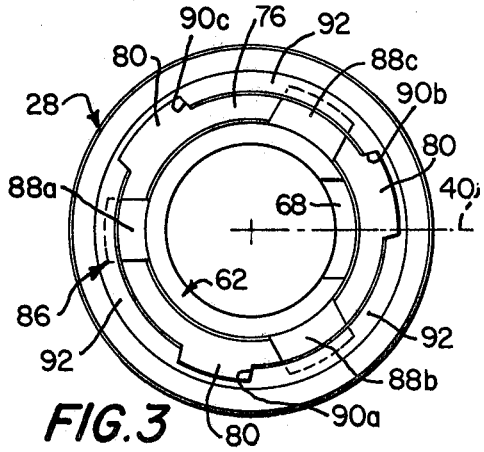
FIG. 3 is a top plan view of the locking components of the pump showing the same in a locked condition.
Figure 5:
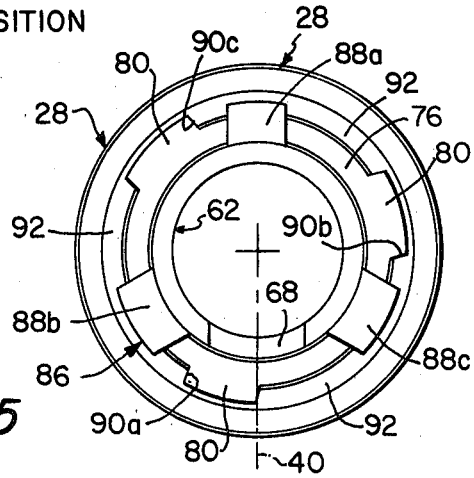
FIG. 5 is a top plan view of the locking components showing the locking lugs in a random position normally associated with regular pumping operations.

The collar 28 includes an outer cylinder 74, an intermediate cylinder 76 of reduced diameter with respect to the outer cylinder 74, and an inner cylinder 78 of still further reduced diameter. The intermediate cylinder 76 is recessed from the top of the outer cylinder 74 and is connected thereto by a series of three radially extending bridges 80 as seen in FIG. 3 and FIG. 5, as well as FIG. 2, while the inner cylinder 78 is substantially further recessed and is integrally connected to the intermediate cylinder 76 at its lower end via a continuous, annular connection 82. The upper end of the body 24 projects securely between the outer cylinder 74 and the intermediate cylinder 76, and the sleeve 62 is received between the intermediate cylinder 76 and the depending annular portion 58 of the head 34. The fit between the sleeve 62 and the intermediate cylinder 76 is such that the head 34 and the sleeve 62 can rotate relative to the intermediate cylinder 76. In a similar way, the fit between the inner cylinder 78 and the plunger 32 is such that the latter can rotate freely relative to the cylinder 78, although the annular connection 82 between the intermediate cylinder 76 and the inner cylinder 78 is provided with an upwardly projecting, annular tongue 84 that is sealingly and matingly received within the groove 72 of sleeve 62 when the plunger 32 is in its fully depressed position.

Pursuant to the present invention, locking means broadly denoted by the numeral 86 is provided between the plunger 32 and the collar 28 for the purpose of releasably retaining the plunger 32 in a down-and-locked position as illustrated in FIG. 2. Broadly stated, the locking means 86 includes a series of three radially projecting lugs 88 on the sleeve 62 of the plunger 32, a corresponding set of three lug-receiving notches 90 in the collar 28, and a corresponding series of three retaining shoulders 92 interspersed between the receiving notches 90. The notches 90 open axially of the pump 10 so as to be in position to receive the lugs 88 when the latter are properly vertically registered therewith, and the shoulders 92 project radially inwardly beyond the radially outer terminations of the lugs 88. Accordingly, when the lugs 88 are inserted into the notches 90 and the plunger 32 is then rotated in a clockwise direction viewing FIGS. 3, 4 and 5, the lugs 88 come to underlie the shoulders 92 and prevent upward extension of the plunger 32. On the other hand, when the pump is in an unlocked mode as illustrated in FIG. 5, the lugs 88 overlie the shoulders 92 and thereby serve as stroke limiters upon depression of the plunger 32.

One of the lugs 88*a* is narrower than the other two lugs 88*b* and 88*c* and, correspondingly, one of the notches 90*a* is narrower than the other two notches 90*b* and 90*c*. Thus, the lugs 88 may only be received by the notches 90 when the lug 88*a* is registered with the notch 90*a*.

As illustrated perhaps most clearly in FIGS. 6 and 7, each of the shoulders 92 is provided with a depending abutment 94 located at the clockwise end of the shoulder 92 as viewed from the top. Each abutment 94 projects radially inwardly to the same extent as its corresponding shoulder 92 so as to be located in the path of travel of the corresponding lug 88*a*, 88*b* or 88*c* as it is shifted beneath the shoulder 92 during clockwise rotation of the plunger 32. Abutments 94 thereby serve to limit such rotation of the plunger 32 in a clockwise direction when the pump 10 is in its locking mode.

As also shown perhaps most clearly in FIG. 7, the underside of each shoulder 92 is provided with a lug-engaging surface 96 that is progressively inclined axially downwardly as the abutment 94 is approached. Such surface 96 has the effect of applying progressively increasing, axially downwardly directed compressive loading to the plunger 32 through the lugs 88 as the plunger 32 is rotated into its locked mode with the lugs 88 engaging the abutments 94.

OPERATION

The general operation of the pump 10 is readily apparent from the foregoing description. Suffice it to point out, then, that as the plunger 32 is depressed, a portion or dose of products held within the container 14 is dispensed through the spout 40. As the plunger 32 is withdrawn or extended, the next charge of products is drawn into the body 24 to be dispensed during the following down stroke of the plunger 32. The lugs 88 of the lock 86 overlie the shoulders 92 during such operation, a typical example of that relationship being illustrated in FIGS. 5 and 9, although because the plunger 32 is freely rotatable within the collar 28 when unlocked, the lugs 88 may be located at any of an infinite number of random locations about the collar 28. As a result of this relationship, the lugs 88 quite effectively limit the down stroke of the plunger 32 by engaging the top side of the shoulders 92 upon depression of the plunger 32 to thereby help assure that precise quantities of products are dispensed during repeated pumping strokes.

Notwithstanding the ability of the plunger 32 to be locked down, the likelihood that precise portioning will be achieved is enhanced by virtue of the fact that the plunger 32 may be placed in its locking mode only when the plunger 32 is in one particular rotative position, i.e., that position in which the small lug 88*a* is aligned with its corresponding, small notch 90*a*. In view of the built-in rotatability of the plunger 32 relative to the collar 28 leading to random positioning of the plunger 32, rotatively speaking, during use, the chances that the small lug 88*a* will be aligned with its small notch 90*a* during any given down stroke of the plunger 32 are relatively slim. Consequently, during normal use, there is little likelihood that the down strokes of the plunger 32 will exceed the normal down stroke determined by the lugs 88 striking the top sides of the shoulders 92.

Figure 4:
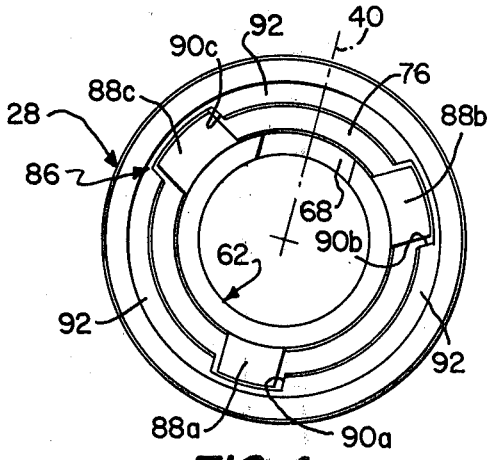
FIG. 4 is a top plan view of the locking components in an unlocked condition with the locking lugs aligned with their receiving notches.

Primary use of the lock 86 may thus be seen as occurring during initial shipment of the goods from the factory where the containers 14 are filled with products, and also during such time as the goods are displayed on merchandising shelves and carried home with other groceries and the like. Manifestly, shifting the plunger 32 to its fully depressed position with the small lug 88*a* fully aligned with its small notch 90*a* as illustrated in FIG. 4, and thereupon rotating the plunger 32 in a clockwise direction viewing that figure causes the lugs 88 to slip beneath the overhanging shoulders 92 as illustrated in FIG. 3. Continued clockwise rotation of the plunger 32 until the lugs 88 strike the abutments 94 of FIGS. 6 and 7 completes lock down of the plunger 32 and causes a compressive thrust to be exerted by the inclined surfaces 96 on the underside of the shoulders 92. This progressively increasing thrust as the plunger 32 is locked down has the effect of "cinching up" the various seal points throughout the pump 10 including, for example, the seal point defined by the inlet 42 and ball valve 44. The projection 56 of plunger 32 forcibly engages and holds down the ball 44 against the inlet 42 at this time. Similarly, a seal point is located between the sealing tongue 84 and its receiving groove 72 of the collar 28 and the plunger 32 respectively. Thus, rough handling, laying the container 14 on its side or even inverting the container 14 after the plunger 32 is fully locked down and its seal points are properly closed, does not present a problem insofar as product leakage is concerned.

It is to be noted that while the compressive loading supplied by the cam surfaces 96 of shoulders 92 is indeed desirable, a delicate balance must be achieved between the torque required to unlock the plunger 32 and that required to cause rotation of the collar 28 relative to the body 24. In this regard, it is necessary that less torque be required to rotate the plunger counterclockwise and move the lugs 88 from their position of FIG. 3 to their position of FIG. 4 than is required to overcome the frictional force between the beads and grooves 30 holding the collar 28 against counterclockwise rotation relative to the body 24. Otherwise, attempts to unlock the plunger 32 would simply result in conjoint rotation of the collar 28 so that the lugs 88 would not be moved to their unlocking positions relative to the collar 28.

Figure 1:
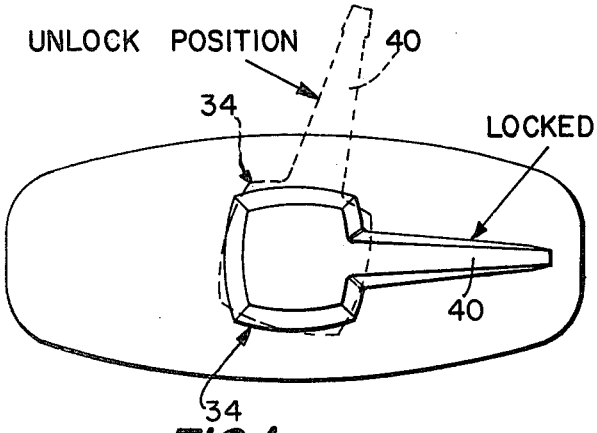
FIG. 1 is a schematic top plan view of a product container employing a pump constructed in accordance with the principles of the present invention, the spout of the pump being illustrated in solid lines with its longitudinal axis aligned with the elongation of the container and being shown in broken lines in an unlocked position.

On the other hand, the fact that the collar 28 is indeed rotatable relative to the body 24 upon the application of sufficiently high torque can be of assistance during preparation of the containers 14 and their pumps 10 for packaging. In this regard, as illustrated in FIG. 1, the container 14 with which the pump 10 is associated may frequently be generally oval in transverse cross section. Where the pump 10 includes a dispensing spout such as the spout 40 herein illustrated, it is desirable for the sake of packaging efficiencies to orient the spout 40 in line with the elongation of the container 14 in the manner illustrated in solid lines in FIG. 1. By the same token, however, such orienting must not interfere or adversely affect the locking feature of the pump 10. In other words, orienting the spout 40 as a final step on the automated "fill line" for the container 14 must not unlock the plunger 32 or otherwise adversely affect the lock 86.

Such is readily accommodated in the present invention because when the plunger 32 is fully down and locked, the lugs 88 are in their full clockwise most positions engaging the abutments 94. Thus, assuming that the spout 40 is out of the aligned position shown in solid lines in FIG. 1 as the container 14 moves along the fill line, the spout 40 may be engaged by a stationary cam or the like alongside the fill line to drive the spout 40 in a clockwise direction sufficient to properly align it with the elongation of the container 14. Because the lugs 88 are fully against the abutments 94 at this time, there is no movement of the plunger 32 relative to the collar 28. However, the resistance between the collar 28 and the body 24 is overcome, and the collar 28 rotates with the plunger 32 to the extent necessary to properly align the spout 40. Thus, when the user first unlocks the plunger 32 by rotating the same counterclockwise to the broken line position of FIG. 1, the spout 40 will be properly positioned to dispense products without depositing the same upon the container 14.

We claim:

1. In a down-locking pump, the improvement comprising:

a tubular body having an inlet at one open end thereof and an annular collar at the opposite, open end thereof;

a valve operably associated with said inlet for opening and closing the same;

a tubular plunger telescopically and rotatively received by said collar for movement in opposite axial directions within the body through pumping strokes, said plunger being operable, when fully depressed, to maintain said valve in a position sealably closing said inlet;

seal structure including cooperating portions on said collar and said plunger respectively and operable, when said plunger is fully depressed, to seal the interface between the collar and the plunger, said cooperating portions of the seal structure, the collar, and the plunger all being constructed from the same material;

a plurality of generally radially outwardly projecting locking lugs carried by said plunger adjacent the normally outer end thereof;

a plurality of notches in said collar adapted to selectively receive said lugs of the plunger when the latter is in said fully depressed position;

a plurality of shoulders interspersed between said notches and disposed to restrictively overlie said lugs and prevent extension of the plunger when the lugs have been received in said notches and the plunger rotated relative to the collar, said shoulders being provided with normally downwardly facing inclined surfaces disposed to bear against the normally upper extremities of said lugs with progressively increasing force as the plunger is rotated in one direction with the lugs disposed beneath the shoulders whereby to establish proper forcible interengagement between the portions of said seal structure and to properly maintain said inlet valve closed; and limit means on said collar normally below said shoulders presenting a normally upwardly facing surface in spaced opposition to said downwardly facing surfaces of the shoulders for cooperating with the latter in traping said lugs against movement in either axial direction once the lugs have been locked beneath said shoulders to thereby absorb shock loading which would otherwise be transmitted to said seal portions, the minimum spacing between said opposed traping surfaces of the collar being substantially the same as the thickness of said lugs in the axial direction.

2. In a pump as claimed in claim 1, wherein each of said shoulders is further provided with an abutment at one termination of said surface in position to block further rotation of the plunger in said one direction.

3. In a pump as claimed in claim 1, wherein said collar includes a generally cylindrical outer portion and a generally cylindrical inner portion spaced radially inwardly from said outer portion, said inner portion having an axial end extremity presenting said limit means.

4. In a pump as claimed in claim 3, wherein said portions are provided with bridging means integrally interconnecting the same at said end extremity.

5. In a pump as claimed in claim 1, wherein said lugs and said notches are so configured that the lugs may enter the notches only in a certain, predetermined rotative position of the plunger.

6. In a pump as claimed in claim 5, wherein two of said lugs and their corresponding notches are mutually identically configured, the third of said lugs and its corresponding notch being differently configured relative to said two lugs and notches.

7. In combination with a container having a lateral extremity and a top, a pump for dispensing product from the container comprising:

a plunger;

a collar guiding the plunger for reciprocation relative thereto and including means for attaching the pump to the top of the container;

a plurality of generally radially outwardly projecting lugs carried by said plunger adjacent the normally outer end thereof;

a plurality of notches in said collar adapted to selectively receive said lugs of the plunger when the latter is in said depressed position;

a plurality of shoulders interspersed between said notches and disposed to restrictively overlie said lugs and prevent extension of the plunger when the lugs have been received in said notches and the plunger rotated relative to the collar;

an abutment positioned adjacent one end of at least one of said shoulders respectively below the same and in spaced relationship to the notch corresponding therewith for limiting the extent of rotation of the plunger relative to the collar when the lugs are locked beneath said shoulders, said attaching means including structure operable to permit said plunger and collar to be rotated as a unit relative to the container top in a direction pressing said lugs against said abutments; and an elongated dispensing spout projecting laterally from the outer end of the plunger, said spout being positionable with its outermost end disposed within the lateral extremity of the container when the plunger and collar are locked together for rotation whereby to facilitate packaging and shipping, said spout, said plunger, said lugs, said notches and said abutments being so positioned relative to each other and to the lateral extremity of the container that upon unlocking rotation of the plunger from said disposition of the outer end of the spout within the lateral extremity of the container to a disposition realigning the lugs with their notches for an upstroke of the plunger, and then further rotation of the plunger once unlocked to a normal use position in which the outer end of the spout projects its greatest distance from and beyond said extremity of the container, said lugs are disposed out of alignment with their notches to reduce the chances of the lugs becoming unintentionally realigned with their notches during operation of the pump in said normal use position.

* * * * *